US008221115B2

(12) United States Patent
Targoff

(10) Patent No.: US 8,221,115 B2
(45) Date of Patent: Jul. 17, 2012

(54) FUEL COMBUSTION

(75) Inventor: Jason A. Targoff, Cambridge, MA (US)

(73) Assignee: Tiax LLC, Lexington, MA (US)

( * ) Notice: Subject to any disclaimer, the term of this patent is extended or adjusted under 35 U.S.C. 154(b) by 0 days.

(21) Appl. No.: 12/601,802

(22) PCT Filed: May 23, 2008

(86) PCT No.: PCT/US2008/064695

§ 371 (c)(1),
(2), (4) Date: Apr. 30, 2010

(87) PCT Pub. No.: WO2008/147987

PCT Pub. Date: Dec. 4, 2008

(65) Prior Publication Data

US 2010/0216079 A1 Aug. 26, 2010

Related U.S. Application Data

(60) Provisional application No. 60/931,919, filed on May 25, 2007.

(51) Int. Cl.
*F23C 1/00* (2006.01)

(52) U.S. Cl. ..... 431/8; 431/12; 431/2; 431/89; 431/181

(58) Field of Classification Search ..... 431/8, 12, 431/2, 89, 181, 90
See application file for complete search history.

(56) References Cited

U.S. PATENT DOCUMENTS 3,291,191 A * 12/1966 Stoops ..... 431/11
5,400,969 A * 3/1995 Keene ..... 239/136
5,680,766 A * 10/1997 Joshi et al. ..... 60/746
2005/0250061 A1* 11/2005 Lochschmied ..... 431/75

* cited by examiner

*Primary Examiner* — Alfred Basichas
(74) *Attorney, Agent, or Firm* — Cantor Colburn LLP

(57) ABSTRACT

A system includes a first source containing a liquid fuel, a second source containing a gaseous fuel, and a combustion burner connected to the first and second sources and selectively in fluid communication with the liquid fuel and the gaseous fuel to receive the fuels. The burner is capable of switching between combustion of the liquid fuel and combustion of the gaseous fuel without modification to the burner or the system.

63 Claims, 6 Drawing Sheets

FUEL COMBUSTION

CROSS-REFERENCE TO RELATED APPLICATIONS

This application is a national stage application under 35 U.S.C. §371 of International (PCT) Patent Application No. PCT/US2008/064695, filed May 23, 2008, titled FUEL COMBUSTION, and published under PCT Article 21(2) in English, which claims priority to U.S. Patent Application No. 60/931,919, filed on May 25, 2007, titled FLEXIBLE FUEL COMBUSTION, the entire contents of each of which are herein incorporated by reference for all purposes.

FIELD OF THE INVENTION

The invention relates to fuel combustion systems, components, and methods.

BACKGROUND

Liquid fuel burners can be classified into two categories: atomizing burners and vaporizing burners. In an atomizing burner, combinations of high pressures and high velocity air are used to flow liquid fuel through an orifice and to break up the fuel into small droplets. The small droplets of fuel mix with air, vaporize and burn, usually more readily than larger droplets of fuel, due to surface-to-volume ratio effects. In a vaporizing burner, fuel is heated and vaporized without the aid of atomization. The vaporized fuel then mixes with air and burns. In some cases, electric heaters are used to help vaporize the fuel; in other cases, heat from the combustion process is sufficient to vaporize the fuel. Pre-heated air can also help vaporize fuel from a wick.

Gaseous fuel burners need not vaporize fuel since the fuel starts in the vapor phase. Many gaseous fuel burners pre-mix or partially pre-mix fuel and air prior to combustion. A flame can be stabilized using recirculation of hot exhaust products, or by the use of a bluff body, or by the use of a foam or a fibrous material to pre-heat the fuel-air mixture and then to stabilize the flame on the metal fiber or foam, or by the use of a swirling flow-field which can re-circulate exhaust products and stabilize the flame over large variations in supply velocity.

SUMMARY

The invention relates to fuel combustion systems, components, and methods.

The invention provides components, systems and methods to vaporize liquid fuels and to burn them with very low emissions in a burner that can also cleanly burn gaseous fuels. The burner and a controller for the burner can be used, for example, in external combustion engines, chemical processors, or heaters. In some embodiments, the burner is a swirl-stabilized burner that can stabilize combustion over a wide range of fuel types, including liquid or gaseous fuels, firing rates, and air/fuel ratios. Fuel flexibility of a burner or external combustion system can be very useful in emergency situations when choices of fuel can be limited.

The burner incorporates a mechanism for vaporizing liquid fuels without interrupting the swirl-stabilization and with limited tendency for coke formation. Gaseous fuels can operate on the same burner and pass through the vaporizing mechanism before mixing with air and combusting. The controller allows one system to operate with gaseous or liquid fuels without changes to any hardware; that is, a single burner can operate with gaseous fuels as well as liquid fuels.

In one aspect, the invention features a system, including a first source containing a liquid fuel; a second source containing a gaseous fuel; and a combustion burner connected to the first and second sources and selectively in fluid communication with the liquid fuel and the gaseous fuel to receive the fuels, wherein the burner is capable of switching between combustion of the liquid fuel and combustion of the gaseous fuel without modification to the burner or the system.

Embodiments may include one or more of the following features. The system further includes a controller configured to control flow of fuel from the first source or the second source to the burner. The system further includes a controller configured to control flow of fuel from the first source or the second source to the burner based on a measurement of an output of the burner. The system further includes a sensor configured to sense a temperature or a stoichiometry of a fuel/gas mixture. The burner includes a fuel inlet, a fuel outlet, and an air inlet overlapping at least a portion of the fuel outlet along a longitudinal axis of the burner. The air inlet has at least one dimension greater than at least one dimension of the fuel outlet. The burner includes a plurality of air inlets located about a periphery of the burner, the air inlets configured to direct air at a non-perpendicular angle to the periphery. The burner includes a thermally conductive porous material configured to vaporize the liquid fuel. The burner includes a space surrounding the porous material. The burner includes an air inlet and projections downstream of the air inlet, the projections configured to direct air and vaporized fuel in curved direction. The burner includes a burner outlet defined by a portion of a cone. The cone has an angle between approximately 0° and approximately 120°. The burner includes a fuel inlet, a vaporizer cavity in fluid communication with the fuel inlet, a fuel outlet in fluid communication with the vaporizer cavity, an air inlet in fluid communication with the fuel outlet, and a burner outlet in fluid communication with the air inlet. The burner further includes a thermally conductive porous material in the vaporizer cavity. The porous material is in fluid communication with the burner outlet only through the fuel outlet. The burner further includes a heater configured to heat the porous material. The burner further includes a space located downstream of the air inlet and surrounding the vaporizer cavity. The burner further includes projections in the space and configured to direct air and gaseous fuel in curved direction. The air inlet overlaps with at least a portion of the fuel outlet along a longitudinal axis of the burner.

In another aspect, the invention features a method of combustion, including introducing a first fuel in a first phase through a fuel inlet of a burner of a combustion system; and introducing a second fuel through the fuel inlet, the second fuel being in a second phase different from the first phase, wherein introduction of the second fuel to the burner is performed without modifying the burner or the combustion system.

Embodiments may include one or more of the following features. The method further includes controlling flow of the first fuel or the second fuel to the burner based on a measurement of an output of the burner. The method further includes measuring a temperature or an indication of stoichiometry of fuel air mixture of an output of the burner. The burner includes a fuel outlet and an air inlet overlapping at least a portion of the fuel outlet in a radial direction. The air inlet has at least one dimension greater than at least one dimension of the fuel outlet. The method further includes directing air at a non-perpendicular angle to a periphery of the burner. The method further includes vaporizing liquid fuel with a thermally conductive porous material. The method further includes mixing fuel and air in a space surrounding a porous material. The method further includes directing air and fuel in a curved direction. The burner includes a burner outlet defined by a portion of a cone. The cone has an angle from approximately 0° to approximately 120°. The burner includes a fuel inlet, a vaporizer cavity in fluid communication with the fuel inlet, a fuel outlet in fluid communication with the vaporizer cavity, an air inlet in fluid communication with the fuel outlet, and a burner outlet in fluid communication with the air inlet. The burner further includes a thermally conductive porous material in the vaporizer cavity. The porous material is in fluid communication with the burner outlet only through the fuel outlet. The burner further includes a heater configured to heat the porous material. The burner further includes a space located downstream of the air inlet and surrounding the vaporizer cavity. The burner further includes projections in the space and configured to direct air and gaseous fuel in curved direction. The air inlet overlaps with at least a portion of the fuel outlet along a radial direction of the burner. The burner includes a plurality of air inlets located about a periphery of the burner, the air inlets configured to direct air at a non-perpendicular angle to the periphery. The burner outlet is defined by a portion of a cone. The cone has an angle from approximately 0° to approximately 120°.

In another aspect, the invention features a burner, including a fuel inlet; a vaporizer cavity in fluid communication with the fuel inlet; a fuel outlet in fluid communication with the vaporizer cavity; and an air inlet in fluid communication with the fuel outlet, wherein the air inlet overlaps with at least a portion of the fuel outlet along a radial direction of the burner.

Embodiments may include one or more of the following features. The burner further includes a thermally conductive porous material in the vaporizer cavity. The porous material is in fluid communication with a burner outlet only through the fuel outlet. The burner further includes a heater configured to heat the porous material. The burner further includes a space located downstream of the air inlet and surrounding the vaporizer cavity. The burner further includes projections in the space and configured to direct air and gaseous fuel in curved direction. The air inlet overlaps with at least a portion of the fuel outlet along a longitudinal axis of the burner. The burner includes a plurality of air inlets located about a periphery of the burner, the air inlets configured to direct air at a non-perpendicular angle to the periphery. The burner further includes a burner outlet defined by a portion of a cone. The cone has an angle from approximately 0° to approximately 120°.

In another aspect, the invention features a burner, including a fuel inlet; a vaporizer cavity in fluid communication with the fuel inlet; a fuel outlet in fluid communication with the vaporizer cavity; an air inlet in fluid communication with the fuel outlet; and a space located downstream of the air inlet and surrounding the vaporizer cavity.

Embodiments may include one or more of the following features. The burner further includes a thermally conductive porous material in the vaporizer cavity. The porous material is in fluid communication with a burner outlet only through the fuel outlet. The burner further includes a heater configured to heat the porous material. The burner further includes projections in the space and configured to direct air and gaseous fuel in curved direction. The burner includes a plurality of air inlets located about a periphery of the burner, the air inlets configured to direct air at a non-perpendicular angle to the periphery. The burner further includes a burner outlet defined by a portion of a cone. The cone has an angle between approximately 0° and approximately 120°.

A combustion process using the burners described herein can produce a swirl-stabilized flame with a Swirl. Number of from approximately 0.2 to approximately 1.5 (such as from approximately 0.5 to approximately 0.7).

In some embodiments, air can be introduced through an opening or a passageway located at an end portion of a burner.

Embodiments may include one or more of the following advantages.

Having a swirling flame around a vaporizer can allow stabilization of a flame for multiple fuels. In some applications, liquid and gaseous fuels can not be used in the same burner because their flame lengths and flame speeds are significantly different. Having an intense swirling flame can compensate for the different flame characteristics. The swirling flame also allows a vaporizing surface to be placed in the center of the flame with minimal effect on the flame flow field.

Using high speed air around vapor holes can extract fuel vapor and promote pre-mixing of fuel and air, regardless of the type of fuel. Embodiments can operate using liquid or gaseous fuels without modification to the burner.

Vaporization with a foam allows heat transfer to feed fuel even if coke has formed inside the foam. If and when coking occurs, it may not be catastrophic because the foam can distribute heat away from its hottest section so the coke does not prevent further vaporization by its insulating qualities.

The structure of the foam can be mostly voids, which can provide large vaporization surfaces. Having mostly voids and no small orifices can reduce the occurrence of clogging.

In some embodiments, the burners are not readily poisoned by sulfur and/or do not readily decompose at high temperatures, which can occur with other multi-fuel burners such as catalytic burners.

The control system can operate on various fuels without changes to hardware.

As used herein, "without modification to a burner" means that no physical component is added to or removed from the burner. However, operational parameters of the burner, such as fuel flow rates, air flow rates, and temperatures, can change.

As used herein, "without modification to a system" means that no physical component is added to or removed from the system. However, operational parameters of the system, such as flow rates, temperatures, and state of switches, can change.

The details of one or more embodiments are set forth in the accompanying description below. Other aspects, features, and advantages of the invention will be apparent from the following drawings, detailed description of embodiments, and also from the appending claims.

DETAILED DESCRIPTION

Figure 1:
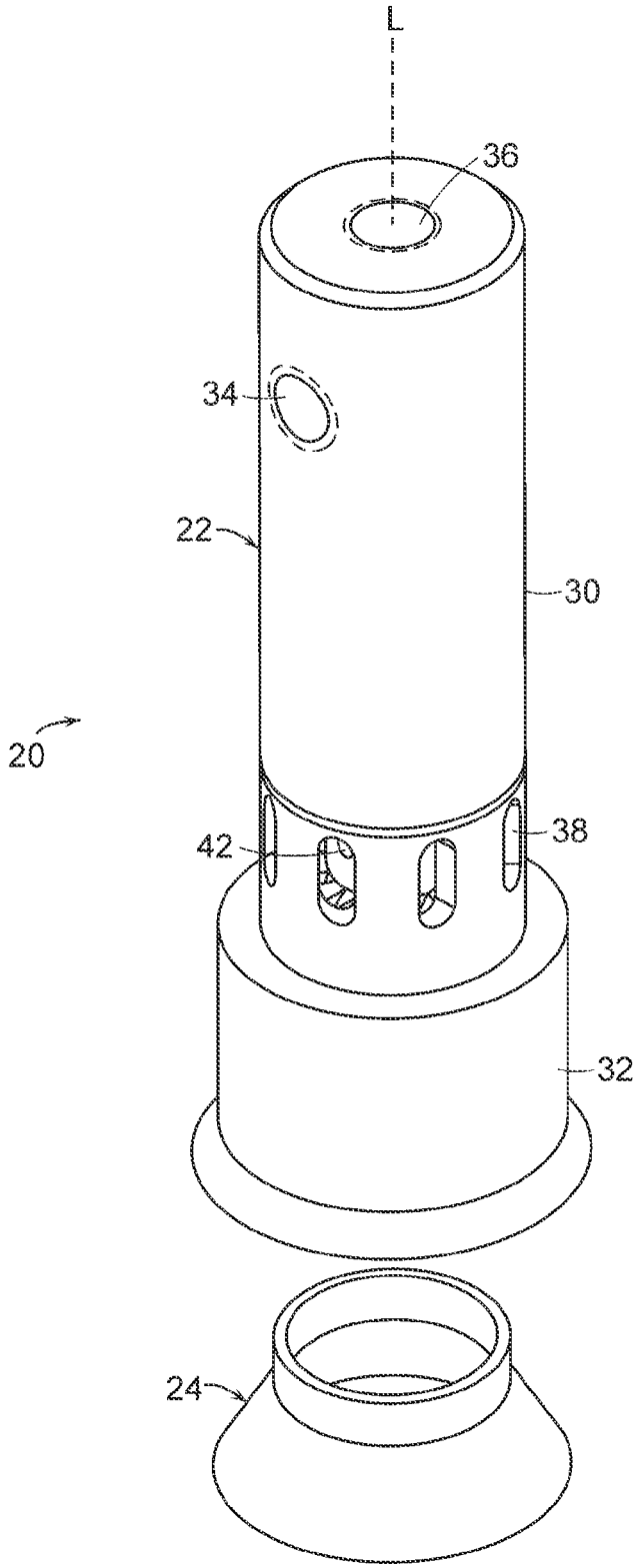
FIG. 1 is a perspective view of an embodiment of a multi-fuel burner with a conically-shaped end piece detached.
Figure 2:
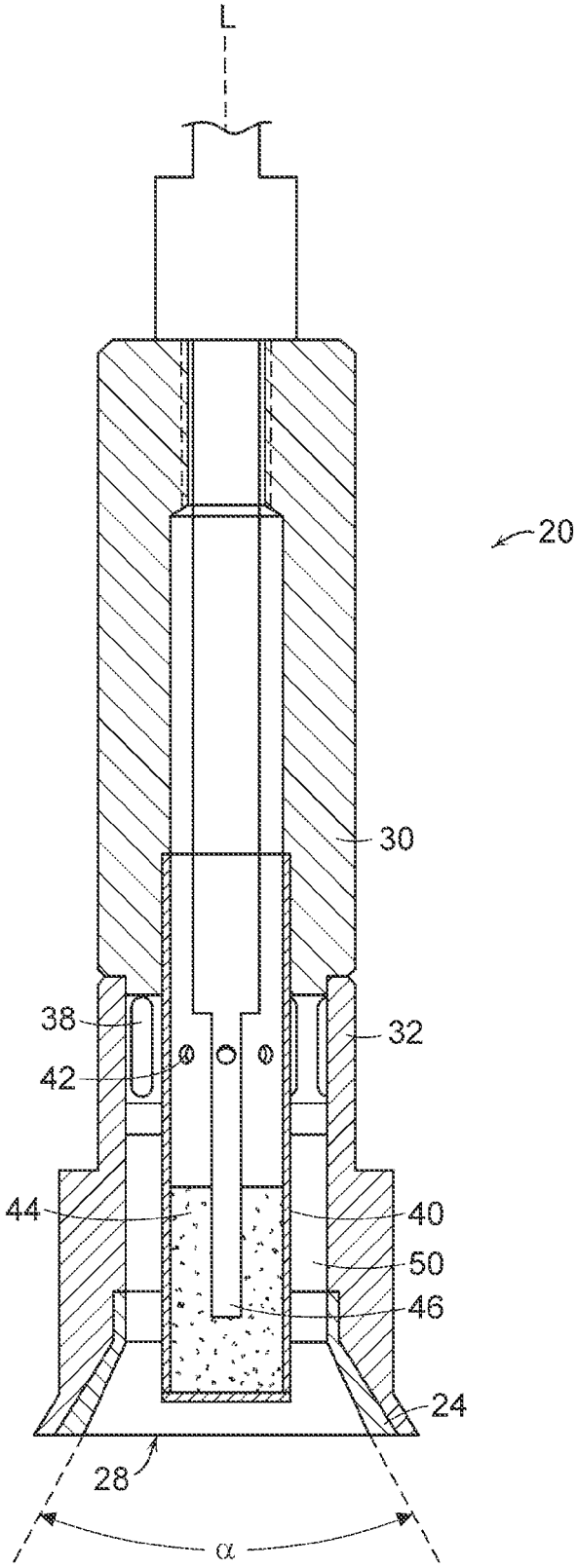
FIG. 2 is a cross-sectional view of the burner shown in FIG. 1, with the conically-shaped end piece attached.

FIGS. 1 and 2 show a combustion burner 20 capable of being used to combust a liquid fuel as well as a gaseous fuel. Burner 20 can be used in systems such as external combustion engines, chemical processors, and heaters. As described herein, switching between combustion of a liquid fuel and combustion of a gaseous fuel can be performed without modifying burner 20 or the system including the burner (e.g., by adding or removing hardware). Furthermore, burner 20 can combust a wide range fuels with low emissions. For example, combustion of kerosene can have emissions of less than approximately 500 ppm CO, even with under 4% excess oxygen (phi of approximately 0.8) in the exhaust. Lower emissions, under 100 ppm CO, are possible with greater amounts of excess air (e.g., phi of 0.7-0.75) in the flame.

Figure 3:
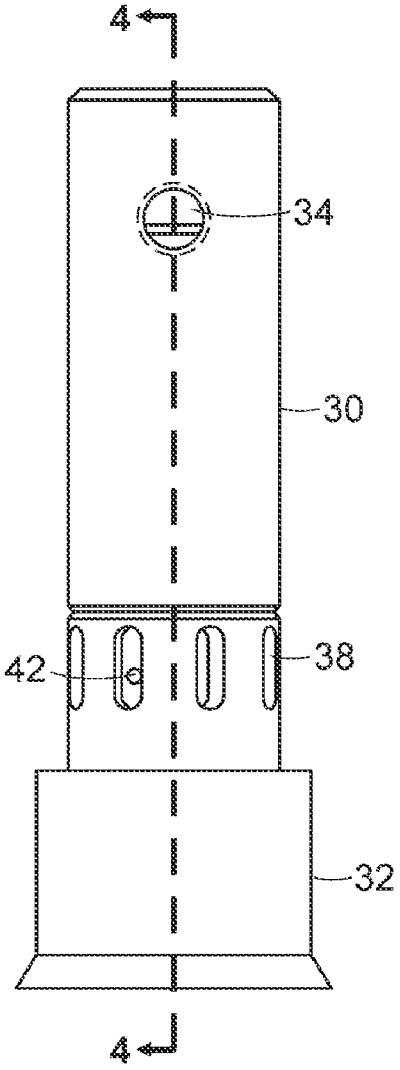
FIG. 3 is a side view of the burner shown in FIG. 1, with the conically-shaped end piece removed.
Figure 4:
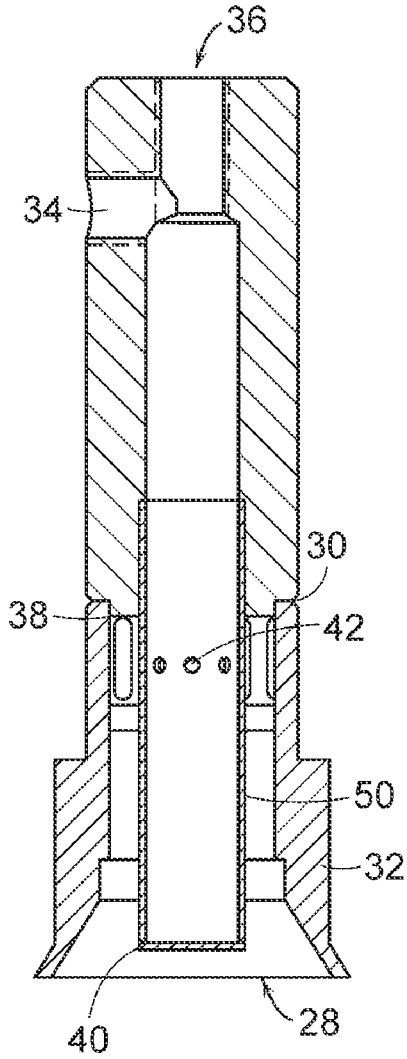
FIG. 4 is a cross-sectional view of the burner shown in FIG. 3, taken along line 4-4.
Figure 5:
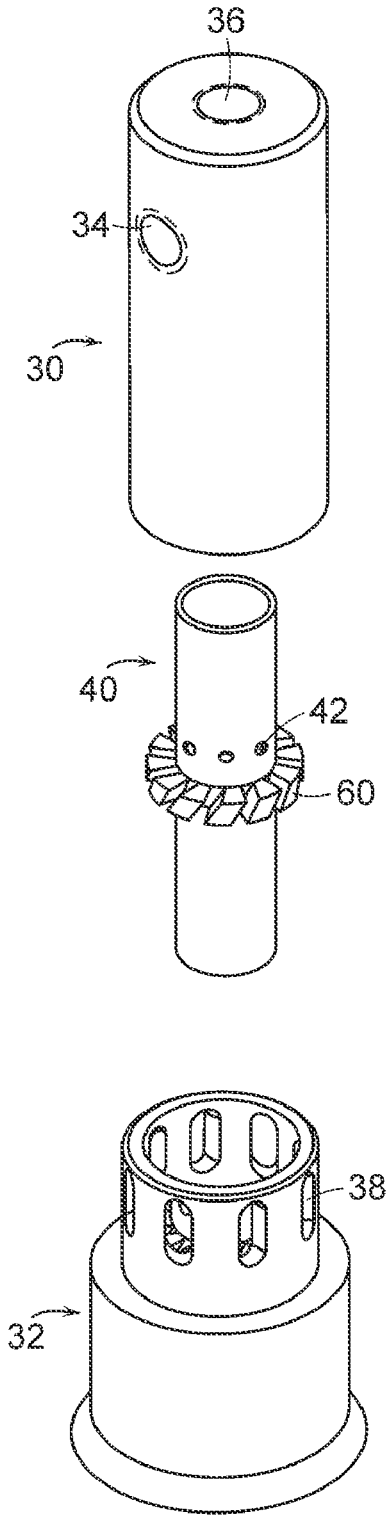
FIG. 5 is an exploded, perspective view of the burner shown in FIG. 3.

Referring also to FIGS. 3, 4 and 5, burner 20 generally includes a housing 22 and a vaporizer 40 in the housing. During operation, fuel is delivered into vaporizer 40 (e.g., to vaporize a liquid fuel), and gaseous fuel and air are mixed in a mixing zone 50 defined between the vaporizer and housing 22. The mixed fuel and air are combusted at a burner outlet 28. More specifically, housing 22 includes an upper body 30 and a lower body 32 that is joined to the upper body. Upper body 30 includes a fuel inlet 34 and a passageway 36 extending along the longitudinal axis (L) of the upper body. Lower body 32 includes a plurality of air inlets 38 arranged around the periphery of the lower body. As shown in FIGS. 1 and 2, burner 20 includes a conically-shaped end piece 24 (which can be unitarily formed with lower body 32) that defines burner outlet 28. Within housing 22, vaporizer 40 (as shown, a cylindrical body having an open end and a closed end) is coaxial with passageway 36 and burner outlet 28. Between vaporizer 40 and housing 22 is air/gaseous fuel mixing zone 50 (as shown, a cylindrical space) where gaseous fuel and air mix prior to combustion. Vaporizer 40 has a plurality of fuel outlets 42 (as shown, round openings) located around the periphery of the vaporizer. As shown in FIG. 2, within vaporizer 40, burner 20 further includes a thermally conductive porous material 44 (e.g., a metal foam) that is capable of vaporizing liquid fuel during use, and a glow plug 46 configured to heat the porous material. In some embodiments, burner 20 does not include porous material 44, but the burner may include glow plug 46.

During operation, a liquid fuel (such as diesel fuel) or a gaseous fuel (such as propane) is introduced through fuel inlet 34 for combustion at burner outlet 28. More specifically, in a "liquid mode" to combust a liquid fuel, glow plug 46 is energized at start-up to heat porous material 44, which is used to provide vaporization heat to vaporize the liquid fuel. In some embodiments, glow plug 46 is energized for up to five minutes prior to fuel introduction and up to five minutes after ignition to ensure complete vaporization at start-up, but as combustion of the liquid fuel proceeds, vaporization heat can increasingly come from radiation from the combustion and convection from the hot gases near burner 20. When glow plug 46 and porous material 44 are sufficiently heated to vaporize the liquid fuel, the liquid fuel is introduced into burner 20 through fuel inlet 34. The liquid fuel then flows to and into porous material 44 where the liquid fuel is vaporized to a gaseous fuel, which then flows through fuel outlets 42. At the same time, air flows through air inlets 38 (e.g., forced by a fan, a blower, or a compressor), and this air mixes with the gaseous fuel exiting fuel outlets 42 in mixing zone 50 prior to combustion near burner outlet 28. The flame is initially ignited with an ignition source, with, for example, a spark plug, a glow plug, or a hot surface igniter, near outlet 28. Once burner 20 is lit, the ignition source is no longer required to maintain combustion. Glow plug 46 can be de-energized, for example, approximately five minutes after ignition.

In a "gas mode" to combust a gaseous fuel, the gaseous fuel is flowed through substantially the same flow path as the flow path of the liquid fuel described above. More specifically, the gaseous fuel is introduced into burner 20 through fuel inlet 34. The gaseous fuel can contact porous material 44 and absorb small quantities of heat, but the fuel does not undergo a phase change as with the liquid fuel. The gaseous fuel then flows through fuel outlets 42. Air introduced through air inlets 38 then mixes with the gaseous fuel exiting the fuel outlets 42 in mixing zone 50, and this air and fuel mixture is combusted near burner outlet 28, initially ignited with an ignition source, as described for the "liquid mode" of operation.

Referring again to FIG. 2, within vaporizer 40 and near its closed end, burner 20 includes porous material 44 that acts as a heat exchanger and a vaporizing surface. Gaseous fuels can enter and exit vaporizer 40 without heat transfer significant to the operation, since heat transfer from a hot surface to gas is far less efficient than heat transfer to a liquid. But with liquid fuels, porous material 44 can enhance the uniformity of the temperature in the vaporizing surface, limiting hot-spots and spreading out the heat, and provide extended surface area at this uniform temperature. During operation, fuel does not reach the hottest surface of the porous material 44 if it is vaporized by the porous material above the bottom surface. Lighter fractions of a heavy-fuel distillate can vaporize sooner, at lower temperatures, and over-heating the fuel and coke formation can be limited by this mechanism. Furthermore, in this vaporization approach, coke formation may not be catastrophic to burner 20. In fact, some very slow coke can build up before the coke formation can affect further fuel vaporization because of the large open volume and surface area of porous material 44. Thus, porous material 44 may be useful to increase the life of burner 20. Porous material 44 also provides good thermal conductivity such that if coke forms on the hottest surface, heat is sufficiently transferred away for vapor to form away from the surface.

Porous material 44 can be formed of any high-temperature tolerant, thermally conductive material having high surface area. For example, computational fluid dynamics analysis of a burner indicates a maximum temperature of a metal foam porous material approaching 600° C. when the burner is operating with kerosene fuel.

As a result, in some embodiments, porous material 44 can withstand temperatures of at least approximately 600° C., such as at least approximately 800° C. without any negative effect, such as oxidation or degradation. Porous material 44 can have a porosity between approximately 60% and approximately 95%. The cell size of porous material 44 can be between approximately 10 ppi (pores per inch) and 100 ppi to gain the advantage of high surface area without negatively affecting flow resistance into the porous material. The structure of porous material 44 provides vaporizing surfaces that remain to provide the heat required to vaporize liquid fuel, for example, if part of the porous material starts to fill with coke. Examples of porous material 44 include metal foams, such as those that include (e.g., is formed entirely) stainless steel or an iron-chromium (FeCr) alloy.

Still referring to FIG. 2, when a gaseous fuel (as delivered or after vaporization) exits fuel outlets 42, the gaseous fuel is mixed with air entering through air inlets 38. As shown, to enhance mixing between the gaseous fuel and the air, fuel outlets 42 and air inlets 38 are aligned along the direction of longitudinal axis L such that at least a portion of at least one fuel outlet overlaps with at least a portion of at least one air inlet along axis L. As shown in FIG. 2, fuel outlets 42 completely overlap with air inlets 38. This overlap allows incoming air to swipe gaseous fuel as the gaseous fuel exits vaporizer 40, thereby providing good mixing. In some embodiments, air inlets 38 have a dimension along longitudinal axis L that is equal to or greater than the dimension of fuel outlets 42 along the longitudinal axis L. In some embodiments, air inlets 38 and fuel outlets 42 do not overlap along longitudinal axis L. For example, fuel outlets 42 can be positioned downstream of air inlets 38 along the flow path of air introduced into a burner.

To further enhance mixing, air inlets 38 are angled to direct incoming air at a non-perpendicular angle to the periphery of burner 20. For example, the wall of lower body 32 that defines air inlets 38 can be angled so that incoming air is directed tangentially to the periphery of burner 20, thereby helping to swirl air and the air/gaseous fuel mixture in mixing zone 50.

In some embodiments, referring to FIG. 5, to enhance mixing in mixing zone 50 even more, burner 20 includes structural features in the mixing zone that help to direct the air/gaseous fuel mixture in a curved or an angular direction about longitudinal axis L (e.g., tangential to the periphery of mixing zone 50). As shown, burner 20 includes a plurality of swirler vanes 60 extending from the outer periphery of vaporizer 40.

The angled direction of incoming air through air inlets 38 and/or the structural features in mixing zone 50 can help generate an air/gaseous fuel swirl in burner 20. The swirl can provide shear layers and an intense mixing stream, which can be particularly important for large fuel molecules with low diffusivity, such as kerosene or DF-2 diesel fuel. The swirl can also offer a flame stability mechanism that can work over a wide range of flame speeds or equivalence ratios. For example, kerosene can be burned with equivalence ratios of between approximately 0.6 and approximately 0.9. The same burner can operate with propane, with equivalence ratios of between approximately 0.6 and approximately 0.9, even though the flame speeds of the two fuels are not the same. In some embodiments, once the gaseous fuel and air mix, the combustion process is stabilized in a swirl-stabilized flame, with Swirl Number ($S_N$) of from approximately 0.2 to approximately 1.5 (such as from approximately 0.5 to approximately 0.7) at burner outlet 28, where $S_N$ is defined as the ratio of the axial flux of the angular momentum to the axial flux of the axial momentum.

Figure 6:
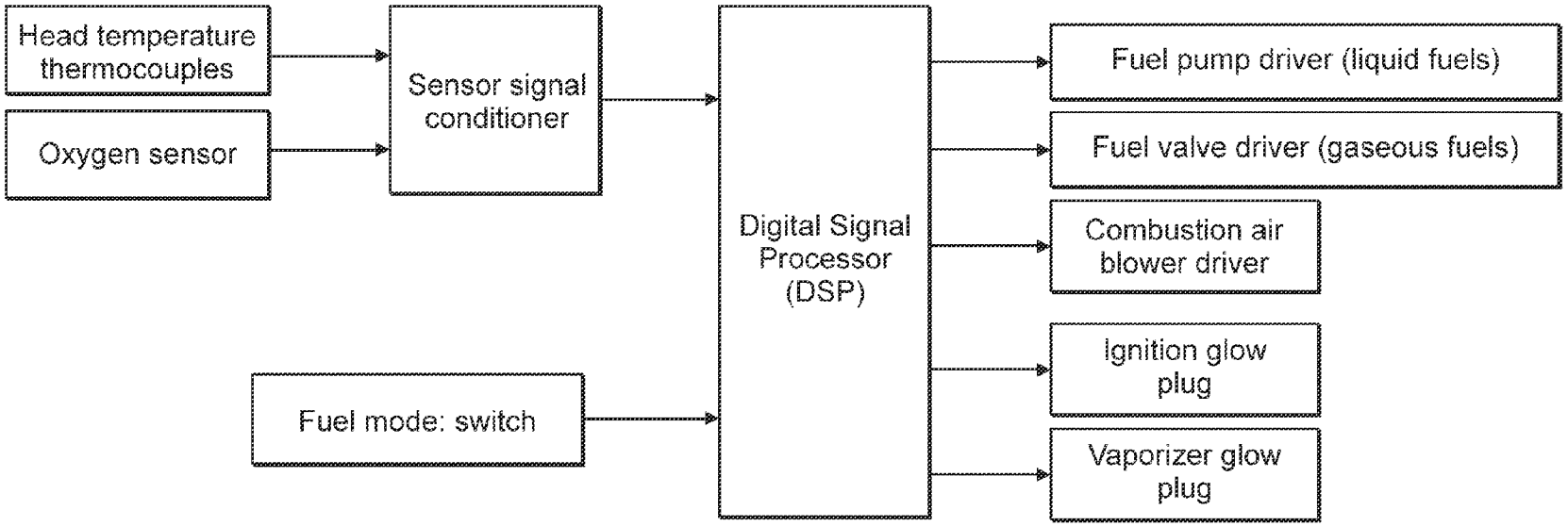
FIG. 6 is a block diagram of an embodiment of a control system including a multi-fuel burner.
Figure 7:
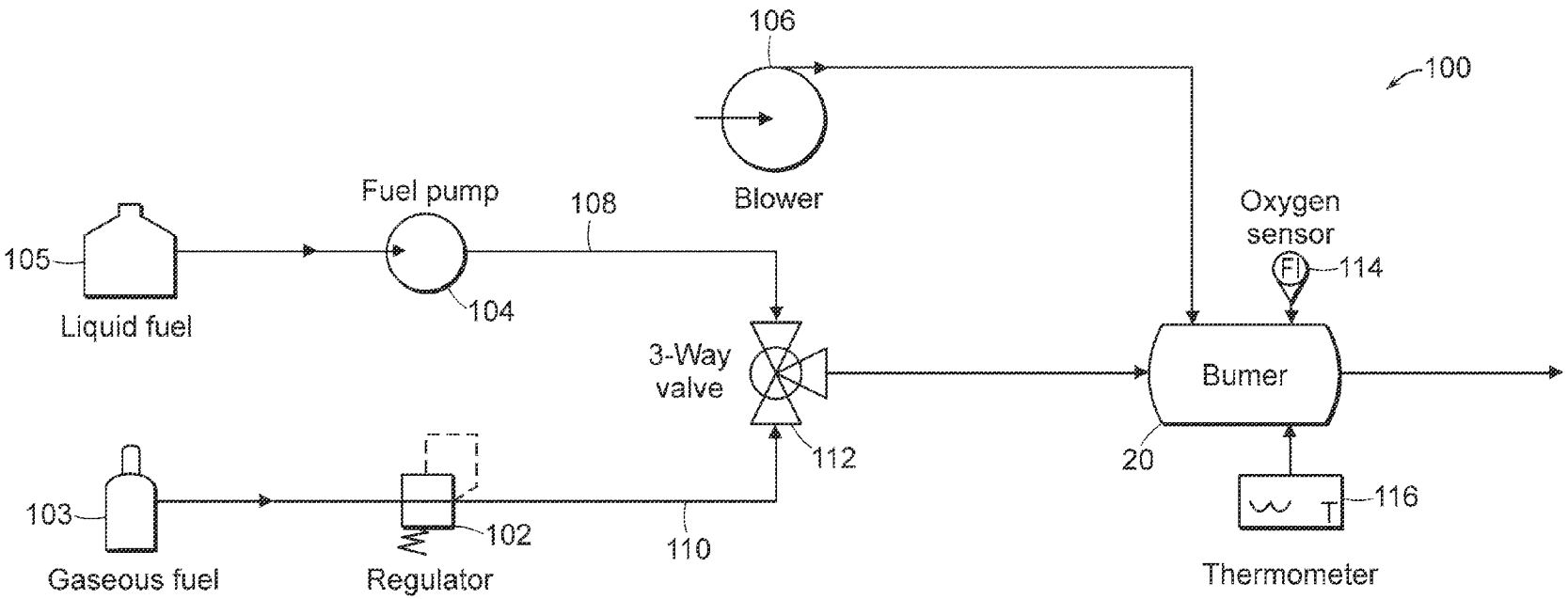
FIG. 7 is a schematic diagram of an embodiment of a control system including a multi-fuel burner.

Referring now to FIGS. 6 and 7, embodiments of burner 20 described herein can be used in an adaptable control system 100. For example, the adaptable control system can be used with external combustion engines to control the combustion process with both gaseous and liquid fuels. As shown, control system 100 includes a mechanism for controlling the supply of air and fuels: a modulating valve 102 can be used to control the flow of gaseous fuels 103; a pump 104 can be used to control the liquid fuels 105; and a blower 106 can be used to supply combustion air to the system. As shown, system 100 includes fuel supply lines 108, 110 that have two connection points: one for liquid fuels 108 and one for gaseous fuels 110. A three-way valve 112 can be used in system 100 upstream of burner 20 to activate one of the lines. In some embodiments, valve 112 has a mechanism, such as a switch, that provides a positive indication that the valve is in a selected mode. The fuel selector switch can provide a positive indication that valve 112 is in the selected gas mode for proper operation of system 100.

In operation, a user-set switch can activate a "liquid mode" or a "gaseous mode" to control system 100. The mode of system 100 can activate controls of burner 20, including, for example, the feed system for the fuel and the air. Fuel flow can be set based on a temperature set-point and a feedback signal from a temperature measurement 116 of the burner 20. Air flow can be set based on fuel flow-based set-point and a feedback signal indicating the stoichiometry of the combustion mixture. This hybrid control system, with a "feedback" term from a sensor 114, combined with a "feed-forward" term based on a fuel rate, can improve stability, e.g., relative to control systems based only on "feedback" responses. A user can activate or select a desired mode of system 100, and since burner 20 can operate very similarly with liquid and gaseous fuels, the same sensors 114, 116 can be used for feedback with both modes.

The feedback systems for the fuel and the air can use the same hardware for both modes, but can have different set-points, depending on the mode. In the case of an external combustion engine, for example, one can control the fuel rate to maintain a temperature on a specified body of the engine. The temperature can be measured by a thermocouple or a resistance temperature detector (RTD), for example. The temperature can be different, depending on whether the mode is liquid or gaseous fuel. The amount of air can be controlled using feedback from a stoichiometry sensor, such as an automotive oxygen sensor, a carbon-monoxide sensor, or a flame rectification sensor, for example. In the case of an oxygen sensor, oxygen content in the exhaust can be pre-specified and be different for liquid fuels and gaseous fuels. A different setting for the feedback value can be specified, depending on the mode of system 100, in order to maintain clean emissions whether liquid or gaseous fuel is being burned. Because flame speeds are more similar within each mode of fuels (gaseous fuels, including natural gas, propane, or butane, and liquid fuels, such as gasoline, kerosene, or diesel), only one oxygen setting may be needed for each mode, and the mode for system 100 can be specified with one switch.

While a number of embodiments have been described, the invention is not so limited.

For example, pre-heated air can also aid in the vaporization process, e.g., if the burner air is recuperated. For example, the burner air can be recuperated by the exhaust gases and reach temperatures approaching 600° C., depending on the extent of recuperation. Air of this temperature can aid in the vaporization process of the fuel.

As another example, referring to FIG. 2, burner outlet 28 can have an angle ($\alpha$) from approximately 0° to approximately 120° (such as from approximately 40° to approximately)80°. A larger cone angle can extend the flame radially and may affect flame stability as well as how heat is transferred from the flame to the body it is heating.

In some embodiments, a burner can be designed so porous material 44 and/or glow plug 46 can be easily replaced after a selected operational interval (like a filter). For example, glow plug 46 and porous material 44 can be manufactured as one pre-assembled package that can be removed together and replaced, such as by using threads of the glow plug to remove and to install the package.

Additionally or alternatively to introducing air into a burner via air inlets positioned at the side of the burner, air can be introduced from an end portion of the burner. For example, the burner can include an annular passageway that coaxially surrounds a glow plug and is in fluid communication with the vaporizer. In embodiments in which there is no glow plug, air can be introduced through passageway 36.

Terms that indicate position, such as "upper", "lower", and "bottom", are used for convenience and with reference to the figures, and are not limiting.

Other embodiments are within the scope of the following claims.

What is claimed is:

1. A system, comprising:

a first source comprising a liquid fuel;

a second source comprising a gaseous fuel; and a combustion burner connected to the first and second sources and selectively in fluid communication with the liquid fuel and the gaseous fuel to receive the fuels, the burner including a fuel inlet, a fuel outlet, and an air inlet having an air inlet opening overlapping at least a portion of a fuel outlet opening of the fuel outlet along a radial axis of the burner;

wherein the burner is capable of switching between combustion of the liquid fuel and combustion of the gaseous fuel without modification of the burner or the system.

2. The system of claim 1, further comprising a controller configured to control flow of fuel from the first source or the second source to the burner.

3. The system of claim 1, further comprising a controller configured to control flow of fuel from the first source or the second source based on a measurement of output of the burner.

4. The system of claim 1, further comprising a sensor configured to sense a temperature or stoichiometry of the fuel/gas mixture.

5. The system of claim 1, wherein the air inlet opening has at least one dimension greater than at least one dimension of the fuel outlet opening.

6. The system of claim 1, wherein the burner comprises a plurality of air inlets located about a periphery of the burner, the air inlets configured to direct air at a non-perpendicular angle to the periphery.

7. The system of claim 1, wherein the burner comprises a thermally conductive porous material configured to vaporize the liquid fuel.

8. The system of claim 7, wherein the burner comprises a space surrounding the porous material.

9. The system of claim 1, wherein the burner further comprises projections downstream of the air inlet, the projections configured to direct air and vaporized fuel in an angular direction.

10. The system of claim 1, wherein the burner comprises a burner outlet defined by a portion of a cone.

11. The system of claim 10, wherein the cone has an angle between approximately 0° and approximately 120°.

12. The system of claim 1, wherein the fuel inlet is in fluid communication with a vaporizer cavity, the fuel outlet is in fluid communication with the vaporizer cavity, and a burner outlet is in fluid communication with the air inlet and the fuel outlet.

13. The system of claim 12, wherein the burner further comprises a thermally conductive porous material in the vaporizer cavity.

14. The system of claim 13, wherein the porous material is in fluid communication with the burner outlet only through the fuel outlet.

15. The system of claim 13, wherein the burner further comprises a heater configured to heat the porous material.

16. The system of claim 12, wherein the burner further comprises a space located downstream of the air inlet and surrounding the vaporizer cavity.

17. The system of claim 16, wherein the burner further comprises projections in the space and configured to direct air an gaseous fuel in an angular direction.

18. The system of claim 12, wherein the burner comprises a plurality of air inlets located about a periphery of the burner, the air inlets configured to direct air at a non-perpendicular angle to the periphery.

19. The system of claim 12, wherein the burner outlet is defined by a portion of a cone.

20. The system of claim 19, wherein the cone has an angle between approximately 0° and approximately 120°.

21. A method of combustion, comprising:

introducing a first fuel in a first phase through a fuel inlet of a burner of a combustion system; and introducing a second fuel through the fuel inlet, the second fuel being in a second phase different from the first phase, wherein introduction of the second fuel to the burner is performed without modifying the burner or the combustion system, the burner including a fuel outlet opening of a fuel outlet and an air inlet opening of an air inlet overlapping at least a portion of the fuel outlet opening in a radial direction.

22. The method of claim 21, further comprising controlling flow of the first fuel or the second fuel to the burner based on a measurement of output of the burner.

23. The method of claim 21, further comprising measuring a temperature or an oxygen content of an output of the burner.

24. The method of claim 21, wherein the air outlet opening has at least one dimension greater than at least one dimension of the fuel outlet opening.

25. The method of claim 21, further comprising directing air at a non-perpendicular angle to a periphery of the burner.

26. The method of claim 21, further comprising vaporizing the liquid fuel with a thermally conductive porous material.

27. The method of claim 21, further comprising mixing fuel and air in a space surrounding a porous material.

28. The method of claim 21, further comprising directing air and fuel in an angular direction.

29. The method of claim 21, wherein the burner comprises a burner outlet defined by a portion of a cone.

30. The method of claim 29, wherein the cone has an angle from approximately 0° to approximately 120°.

31. The method of claim 21, wherein the fuel inlet is in fluid communication with a vaporizer cavity, the fuel outlet is in fluid communication with the vaporizer cavity, the air inlet is in fluid communication with the fuel outlet, and a burner outlet is in fluid communication with the air inlet and the fuel outlet.

32. The method of claim 31, wherein the burner further comprises a thermally conductive porous material in the vaporizer cavity.

33. The method of claim 32, wherein the porous material is in fluid communication with the burner outlet only through the fuel outlet.

34. The method of claim 32, wherein the burner further comprises a heater configured to heat the porous material.

35. The method of claim 32, wherein the burner further comprises a space located downstream of the air inlet and surrounding the vaporizer cavity.

36. The method of claim 35, wherein the burner further comprises projections in the space and configured to direct air and gaseous fuel in an angular direction.

37. The method of claim 32, wherein the burner comprises a plurality of air inlets located about a periphery of the burner, the air inlets configured to direct air at a non-perpendicular angle to the periphery.

38. The method of claim 32, wherein the burner outlet is defined by a portion of a cone.

39. The method of claim 38, wherein the cone has an angle from approximately 0° to approximately 120°.

40. A burner, comprising:

a fuel inlet;

a vaporizer cavity in fluid communication with the fuel inlet;

a fuel outlet in fluid communication with the vaporizer cavity; and an air inlet in fluid communication with the fuel outlet, wherein an air inlet opening of the air inlet overlaps with at least a portion of a fuel outlet opening of the fuel outlet along a radial direction of the burner.

41. The burner of claim 40, wherein the burner further comprises a thermally conductive porous material in the vaporizer cavity.

42. The burner of claim 41, wherein the porous material is in fluid communication with a burner outlet only through the fuel outlet.

43. The burner of claim 40, wherein the burner further comprises a heater configured to heat the porous material.

44. The burner of claim 40, wherein burner further comprises a space located downstream of the air inlet and surrounding the vaporizer cavity.

45. The burner of claim 44, wherein the burner further comprises projections in the space and configured to direct air and gaseous fuel in an angular direction.

46. The burner of claim 40, wherein the air inlet overlaps with at least a portion of the fuel outlet along a longitudinal axis of the burner.

47. The burner of claim 40, wherein the burner comprises a plurality of air inlets located about a periphery of the burner, the air inlets configured to direct air at a non-perpendicular angle to the periphery.

48. The burner of claim 40, wherein the burner further comprises a burner outlet defined by a portion of a cone.

49. The burner of claim 48, wherein the cone has an angle from approximately 0° to approximately 120°.

50. A burner, comprising:

a fuel inlet;

a vaporizer cavity in fluid communication with the fuel inlet;

a fuel outlet in fluid communication with the vaporizer cavity;

an air inlet in fluid communication with the fuel outlet; and a space located downstream of the air inlet and surrounding the vaporizer cavity, the burner including a fuel outlet opening of the fuel inlet and an air inlet opening of the air inlet overlapping at least a portion of the fuel outlet opening in a radial direction.

51. The burner of claim 50, wherein the burner further comprises a thermally conductive porous material in the vaporizer cavity.

52. The burner of claim 51, wherein the porous material is in fluid communication with a burner outlet only through the fuel outlet.

53. The burner of claim 51, wherein the burner further comprises a heater configured to heat the porous material.

54. The burner of claim 50, wherein the burner further comprises projections in the space and configured to direct air and gaseous fuel in an angular direction.

55. The burner of claim 50, wherein the burner comprises a plurality of air inlets located about a periphery of the burner, the air inlets configure to direct air at a non-perpendicular angle to the periphery.

56. The burner of claim 50, wherein the burner further comprises a burner outlet defined by a portion of a cone.

57. The burner of claim 56, wherein the cone has an angle from approximately 0° to approximately 120°.

58. A burner, comprising:

a fuel inlet operably connectable to both a liquid fuel source and a gaseous fuel source and configured to be selectively in fluid communication with the liquid fuel source and the gaseous fuel source to receive a liquid fuel or a gaseous fuel; and a vaporizer cavity in fluid communication with the fuel inlet, the vaporizer cavity including a thermally conductive porous material configured to vaporize the liquid fuel;

wherein the burner is capable of switching between combustion of the liquid fuel and combustion of the gaseous fuel without modification of the burner or the system.

59. The burner of claim 58, wherein the thermally conductive porous material is a metal foam.

60. The burner of claim 58, wherein the thermally conductive porous material is formed from a stainless steel or an iron-chromium alloy.

61. The burner of claim 58, further comprising a glow plug to heat the thermally conductive porous material.

62. The burner of claim 58, wherein the thermally conductive porous material has a porosity of between about 60% and about 95%.

63. The burner of claim 58, wherein the thermally conductive porous material has a cell size between about 10 pores per inch and about 100 pores per inch.

* * * * *